US005692441A

United States Patent [19]

Michalik

[11] Patent Number: 5,692,441

[45] Date of Patent: Dec. 2, 1997

[54] DRAWING ROLLER DRIVE

[75] Inventor: Horst Bernhard Michalik, Höchberg, Germany

[73] Assignee: Koenig & Bauer-Albert Aktiengesellschaft, Wurzburg, Germany

[21] Appl. No.: 726,685

[22] Filed: Oct. 7, 1996

[30] Foreign Application Priority Data

Oct. 7, 1995 [DE] Germany ..... 195 37 422.3

[51] Int. Cl.[6] ..... B41F 13/24

[52] U.S. Cl. ..... 101/232; 101/216; 101/228; 101/232

[58] Field of Search ..... 101/181, 183, 101/216, 217, 228, 232, 247; 226/46; 221/256

[56] References Cited

U.S. PATENT DOCUMENTS

| | | | |
|---|---|---|---|
| 3,828,673 | 8/1974 | Gazzola | 101/232 |
| 4,205,770 | 6/1980 | Wojdyla | 226/49 |
| 4,214,524 | 7/1980 | Corse | 101/181 |
| 4,705,413 | 11/1987 | Arnoldi et al. | 101/232 |
| 5,010,816 | 4/1991 | Sarda | 101/228 |

FOREIGN PATENT DOCUMENTS

| | | |
|---|---|---|
| 43 40 915 | 8/1994 | Germany . |
| 42 10 777 | 7/1995 | Germany . |
| 42 23 900 | 5/1996 | Germany . |

*Primary Examiner*—Christopher A. Bennett
*Attorney, Agent, or Firm*—Jones, Tullar & Cooper, P.C.

[57] ABSTRACT

A drawing roller pair of a web-fed rotary printing press receives a web that is to be conveyed. The axial spacing distance between the two drawing rollers is adjustable by an adjusting spindle. At least one of the rollers carries a resilient transport element whose effective radius will be reduced if the two rollers are moved closer to each other. This will reduce the transport speed of the resilient transport element.

14 Claims, 4 Drawing Sheets

DRAWING ROLLER DRIVE

FIELD OF THE INVENTION

The present invention is directed generally to a drawing roller pair. More particularly, the present invention is directed to a drawing roller pair of a web-fed rotary printing press. Most specifically, the present invention is directed to a drawing roller pair having driving elements and whose axial spacing distance is adjustable. The drawing roller pair is usable in the web-fed rotary printing press to convey a single or a multi-layer web. The driving elements of the roller pair are in driving connection with each other. The circumferential speed of the rollers in the drawing roller pair can be adjusted in an expeditious manner.

DESCRIPTION OF THE PRIOR ART

In the field of web-fed rotary printing, it is generally well known to utilize drawing roller pairs that form a roller gap through which the web or webs pass. In many instances, a typical web-fed press will be used to print on webs having different thicknesses, and to handle single or multi-layer webs which again have differing thicknesses. It is generally known in the prior art to provide an arrangement whereby the speed of rotation of the roller can be adapted to the speed of the web being transported.

One such prior art device is shown in German Patent Publication DE 42 10 777 C2 which discloses and describes a drawing roller pair of a web-fed rotary printing press. The drawing rollers are connected with each other by a differential gear in order to adapt the circumferential speed of the roller pair to charges in the thickness of the web that is fed between the rollers.

A limitation of this prior art drawing roller pair is that the adjustment gear which is provided to change the circumferential roller speed is quite elaborate. The use of such an elaborate adjustment gear gives rise to the likelihood of adjustment problems and mechanical failures.

Another prior art arrangement is shown in German Patent Publication DE 43 40 915 A1. This document discloses a web transport installation with a driven transport roller and against which a pressure roller can be placed. This arrangement of a pressure roller against a transport roll does not allow any change in the web speed to be accomplished.

German Patent Publication DE 42 23 900 C2 discloses a drawing roller for charging a web tension. This roller has a surface whose circumference can be changed by the use of a suitable pressure medium.

These prior art devices do not provide a drawing roller pair that will allow the adjustment of the drawing roller circumferential speed in a simple manner. There is a need for such a device and the drawing roller pair in accordance with the present invention fills that need in a manner which is a significant improvement over the prior art.

SUMMARY OF THE INVENTION

It is an object of the present invention to provide a drawing roller pair.

Another object of the present invention is to provide a drawing roller pair of a web-fed rotary printing press.

A further object of the present invention is to provide a drawing roller pair having driving elements and whose axial spacing is adjustable.

Still another object of the present invention is to provide a drawing roller pair having adjustable circumferential speeds in which the speed adjustment is accomplished by an uncomplicated apparatus.

As will be discussed in detail in the description of the preferred embodiments which are presented subsequently, the drawing roller pair in accordance with the present invention is intended for use in a web-fed rotary printing press and between whose rollers a single or a multi-layer web is conveyed. The drawing roller pair includes cooperating transport wheels or elements and cooperating rollers. At least one of the rollers has an interlocking drive. The transport wheels or elements are adjustable in the radial direction and transport torque. The adjustable axial distance between the rollers can be changed by changing the effective radius of the transport element from a first effective radius to a second effective radius.

A primary advantage of the drawing roller pair in accordance with the present invention is that no elaborate adjustment gears or controllable individual drives are necessary for changing the circumferential speed of the two rollers of the drawing roller pair. An axial spacing distance between the two rollers can be changed in a simple, uncomplicated manner. This allows the roller pair to be adapted quickly to the thickness of a web which is being transported. This change in the axial spacing distance results in a change in the circumferential speed of the rollers in accordance with the thickness of the web which is being transported. The change in the circumferential speed of the roller pair can take place continuously, and viewed in a direction across the width of the web, differently. In a preferred embodiment of the drawing roller pair in accordance with the present invention, in which a compensating element is charged with a pressure medium, it is possible to set a contact pressure of the transport elements on the web continuously and differently over the width of the web. The contrast pressure of the roller pair against the web will remain constant as the circumferential speed of the rollers is adjusted. If the transport element of the drawing roller pair is provided with a divided running surface, it can be replaced without requiring the disassembling of the roller.

The drawing roller pair in accordance with the present invention overcomes the limitations of the prior art. It is a substantial advance in the art.

BRIEF DESCRIPTION OF THE DRAWINGS

While the novel features of the drawing roller pair in accordance with the present invention are set forth with particularity in the appended claims, a full and complete understanding of the invention may be had by referring to the detailed description of the preferred embodiments which is presented subsequently, and as illustrated in the accompanying drawings, in which:

DETAILED DESCRIPTION OF THE PREFERRED EMBODIMENTS

Figure 1:
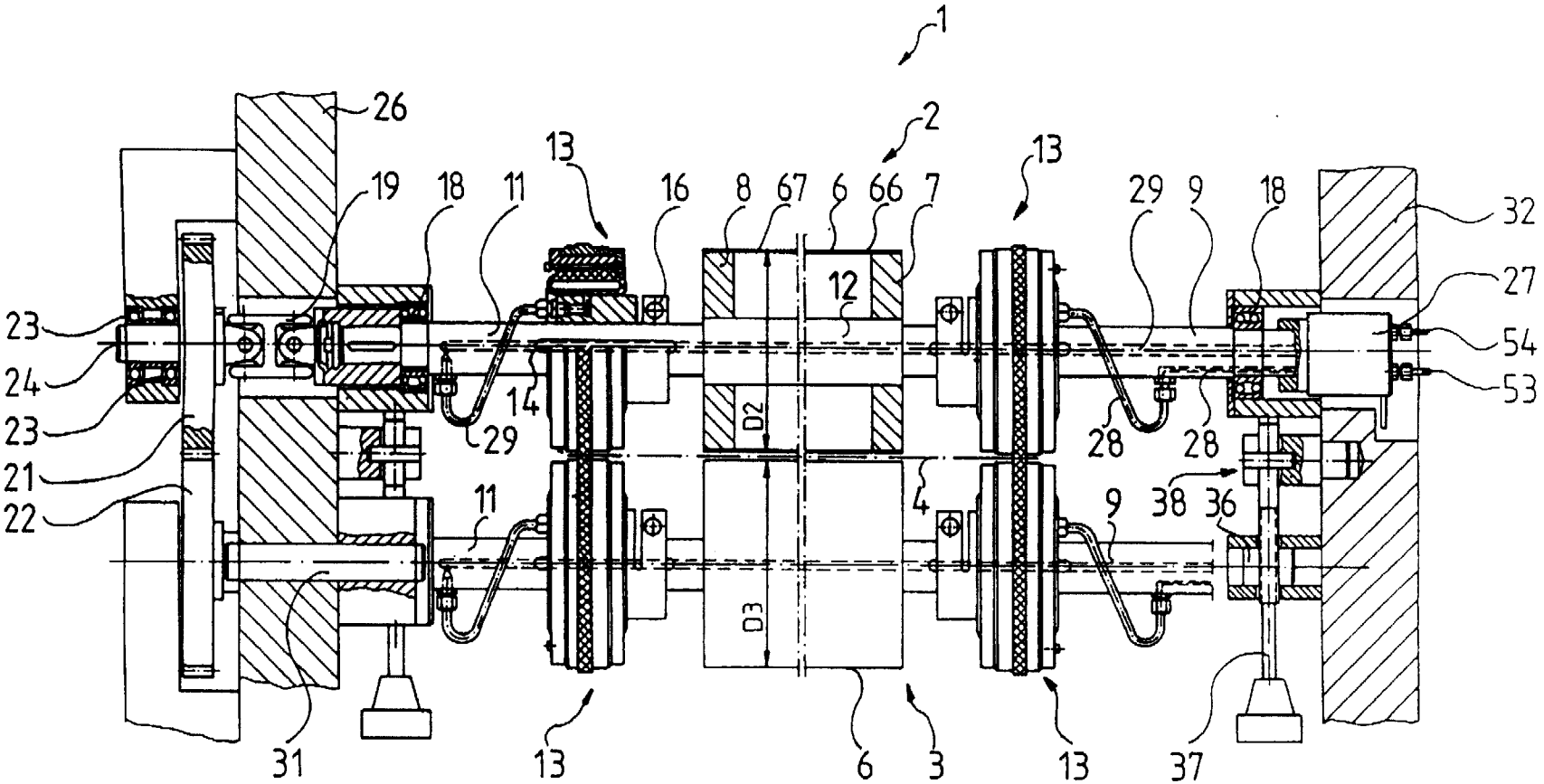
FIG. 1 is a schematic top plan view, partly in section, of a first preferred embodiment of a drawing roller pair in accordance with the present invention.

Referring initially to FIG. 1, there may be seen generally at 1 first preferred embodiment of a drawing roller pair of a web-fed rotary printing press in accordance with the present invention. It will be understood that the drawing roller pair 1 is used in the rotary printing press to transport a web 4 which may be either a single or a multiple layered web 4. The web 4 typically has been or will be printed by the web-fed rotary printing press. The press itself forms no part of the present invention other than to provide support and a source of driving power for the drawing roller pair 1. Accordingly, the web-fed rotary printing press itself will not be discussed in detail.

Figure 2:
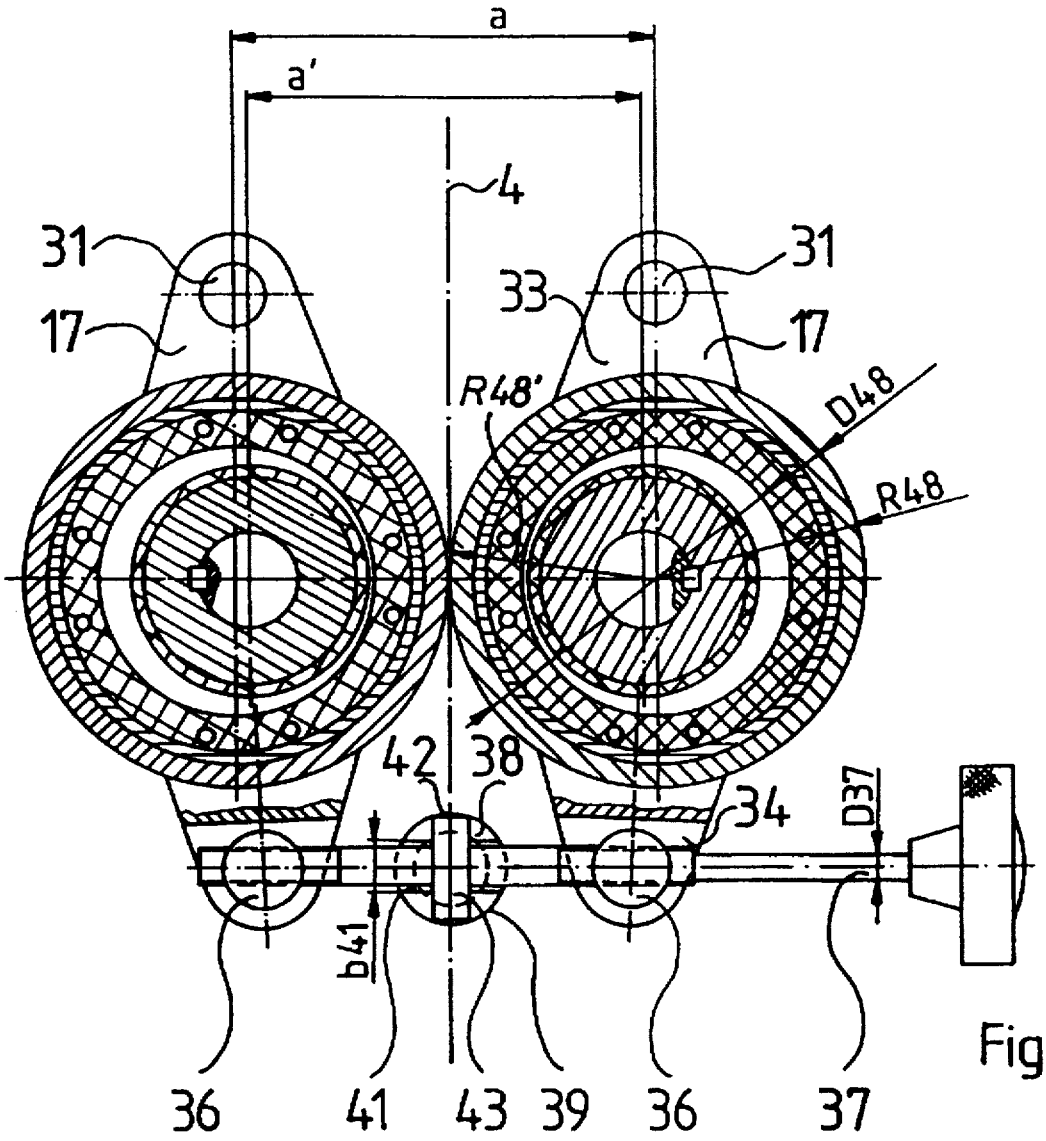
FIG. 2 is a cross-sectional view of the drawing roller pair of FIG. 1.
Figure 3:
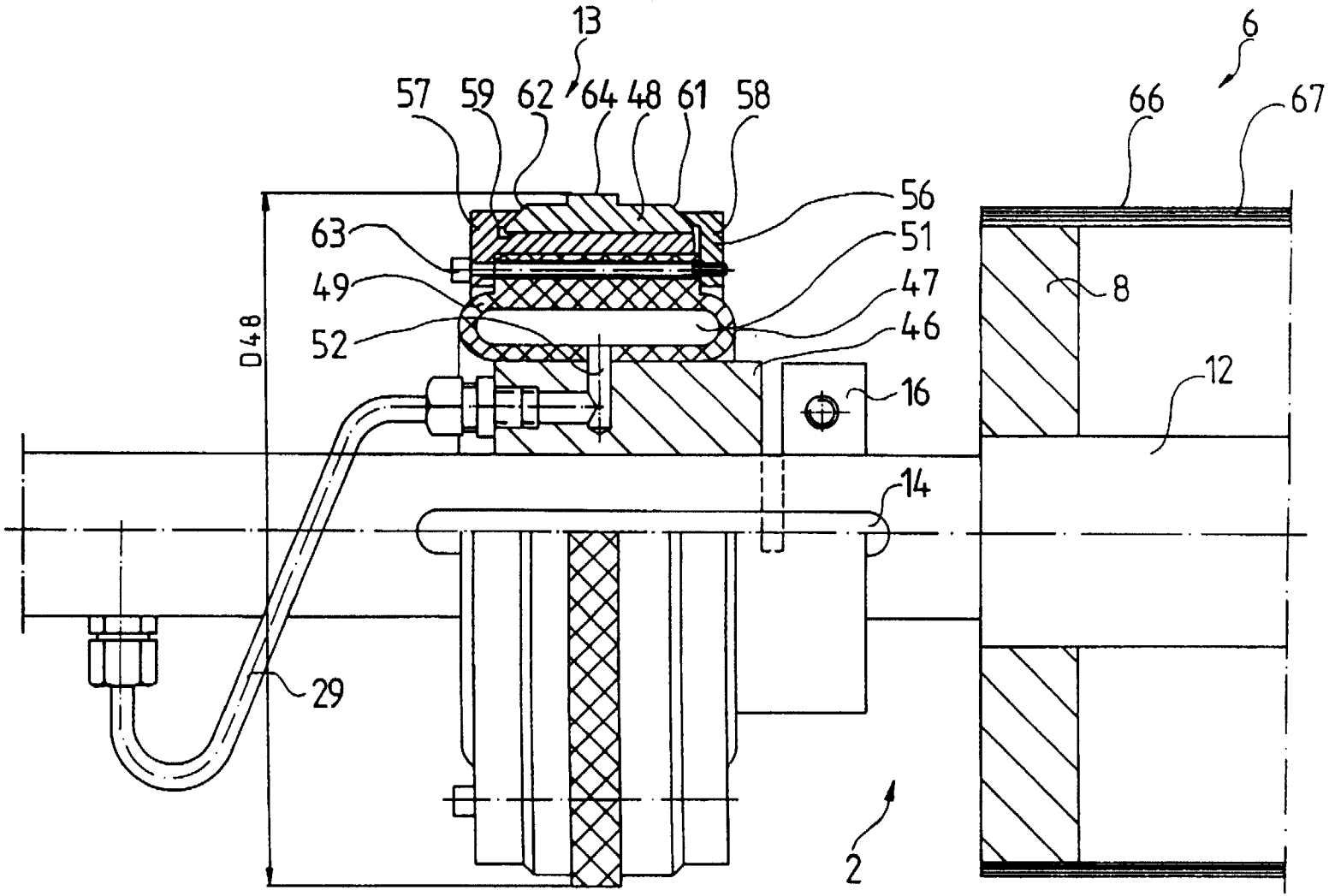
FIG. 3 is an enlarged view, partly in section of one of the transport wheels of the drawing roller pair shown in FIG. 1.

Referring again primarily to FIG. 1, the drawing roller pair 1 of the web-fed rotary printing press consists of two rollers 2 and 3, between which the single- or multi-layered web 4 is conveyed. In the first preferred embodiment, the two rollers 2 and 3 are identically constructed. Each roller 2 or 3 has a cylindrical-tube-like barrel 6 of a diameter D2 or D3, wherein, for example D2=D3=118 mm, and which is rigidly connected on both ends by means of hubs 7 and 8 with two roller journals 9 and 11 of a continuous shaft 12. A transport wheel 13 is fastened as transport element 10, for example, on each roller journal 9 and 11 and is spaced to the right and left of the barrel 6. A feather key 14 and a clamping ring 16 are used to secure each transport wheel 13 to the respective journal, as seen in FIG. 3. The roller journals 9 and 11 are rotatably and tiltably seated in pivotable bearing arms 17 by means of rolling bearings 18, which are, for example, self-aligning ball bearings, as seen in FIGS. 1 and 2. One end of the roller journal 11 of each roller 2 and 3 is connected with a torsion-proof coupling 19 which is structured to compensate for angular and axial offset. This coupling 19 may be, for example, a universal joint shaft. This coupling 19 in turn is respectively fastened on a driving gear wheel 21 that meshes with a similar gear wheel 22 that is attached to the other roller's shaft. Each gear wheel 21 and 22 is rotatably seated in a lateral frame 26 by means of an axle journal 24 having a rolling bearing 23. Thus both rollers 2 and 3 have cooperating driving wheels 21 and 22 respectively, and are in an interlocking, driven connection with a fixed transmission ratio i, for example i=1:1.

A two-conduit rotary inlet 27 is disposed on the oppositely located roller journal 9 and is connected by means of two lines 28 and 29 with the two transport wheels 13 of each roller 2 or 3. This two-conduit rotary inlet 27 is provided with two fluid feed lines 53 and 54 whose purpose and operation will be discussed in greater detail subsequently.

Again referring to FIG. 2, taken in conjunction with FIG. 1, the bearing arms 17 of the rollers 2 and 3 are identically constructed and are each pivotably fastened from an upper first end 33 by means of bolt 31 on an interior side of the lateral spaced frames 26 and 32. A second, lower end 34 of each bearing arm 17 is generally fork-shaped and is provided with a pivotable threaded nut 36. An adjusting spindle 37 of a diameter D37, in which, for example D–37=12 mm, extends through the threaded nut 36, through an adjusting spindle support seat 38, and as far as the threaded nut 36 of the associated lower bearing arm 17 of the second roller 3. The adjusting spindle support seat 38 of the adjusting spindle 37 consists of a pin 39 fixed on the frame, which is provided with two slits 41 and 42 that are placed perpendicularly with respect to each other. Extending parallel with the adjusting spindle 37, one of these slits 41 is made slightly wider, for example, by having a width b41=14 mm, that is larger than the diameter D37 of the adjusting spindle 37. The adjusting spindle 37 is provided with an axially fixed disk 43 approximately at the center, which is disposed in the second slit 42 for the axial securement of the adjustment spindle 37 with respect to the side frames 26 and 32. The threaded nuts 36 of the bearing arms 17 of the rollers 2 and 3, and the adjusting spindle 37 cooperating with them, are provided with right- and left-handed threads. Furthermore, in the instant example the adjusting spindle 37 has an adjusting lever 44 with an integrated position indicator. It is also possible to provide each roller 2 and 3 with its own adjusting spindle 37. This is the case particularly if only one of the two rollers 2, 3 is equipped with elastic transport elements 10, 13. It will be seen that rotation of the adjusting spindle 37 in one direction will pull the two lower ends 34 of the bearing arms 17 toward each other while rotation of the adjusting spindle 37 in the other direction will move the lower ends 34 of the bearing arms 17 apart from each other. The movement of the bearing arms is about the pivot axis defined by each of the support bolts 31 for the bearing arms 17.

The transport elements 10, formed by the transport wheels 13, are embodied so that they transmit torque in the circumferential direction and are elastic, or resilient, in the axial direction. Each of the transport wheels 13 in accordance with the present invention, and as seen in FIGS. 1 and 3, essentially consists of a hub 46, a compensating ring 47 and a transport ring 48. The hub 46 is clamped by means of the feather key 14 in a torsion-free manner to its respective journal 9 or 11, but is axially displaceable on the associated roller journal 9 or 11, if the clamping ring 16 is loosened. The compensating ring 47, in the form of a hose, is fastened on the hub 46, for example by vulcanization. This compensating ring 47 is embodied to transmit torque in the circumferential direction and is elastic, and thus is compressible in the radial direction. For this purpose, a hose wall 49 of the compensating ring 47 is reinforced with inserts, not shown. A pressure chamber 51, that can be charged with a pressure medium, for example compressed air, hydraulic fluid or polyethylene foam, is disposed in the interior of the compensating ring 47. This pressure chamber 51 is connected by means of a bore 52 with the line 28 or 29 and thus with the associated rotary inlet 27. A pressure-regulating valve, not shown, for use in setting the pressure of the pressure medium in the respective pressure chamber 51 is provided for each conduit in a feed line 53 or 54 to the rotary inlet 27. However, it is also possible to dispose a common pressure-regulating valve for all conduits. These pressure-regulating valves can also be remotely controlled by means of a computer. The compensating ring 47 can also be made of an elastomer material, for example. It is also possible to seat the transport ring 48 by means of radially acting springs, which act both on an interior of the transport ring 48 and on an exterior of the hub 46. It is also conceivable to make the transport ring 48 of an elastomer material and to omit the compensating ring 47.

The transport ring 48, which, for example is divided into two parts, is fastened on the radial outer surface of the compensating ring 47 by means of two clamping rings 56 and 57. The two clamping rings 56 and 57 are each provided with a cone-shaped collar 58 or 59, and each cooperate with slanted lateral surfaces 61 or 62 of the transport ring 48 in the circumferential direction in a frictionally connected manner, and in the radial direction in an interlocking manner. For this purpose, the two clamping rings 56 and 57 are braced in the axial direction by means of threaded screws 63 extending through the compensating ring 47. In the present example, the transport ring 48 is provided with an outer running surface 64. To obtain a defined circumferential speed, a diameter D48, in which, for example, D48=123 mm of this transport ring 48 or of the running surface 64 is embodied to be, for example, 2.5% larger than a required nominal diameter dn, for example dn=120 mm. This means that the transport ring 48 is designed to lead.

Figure 4:
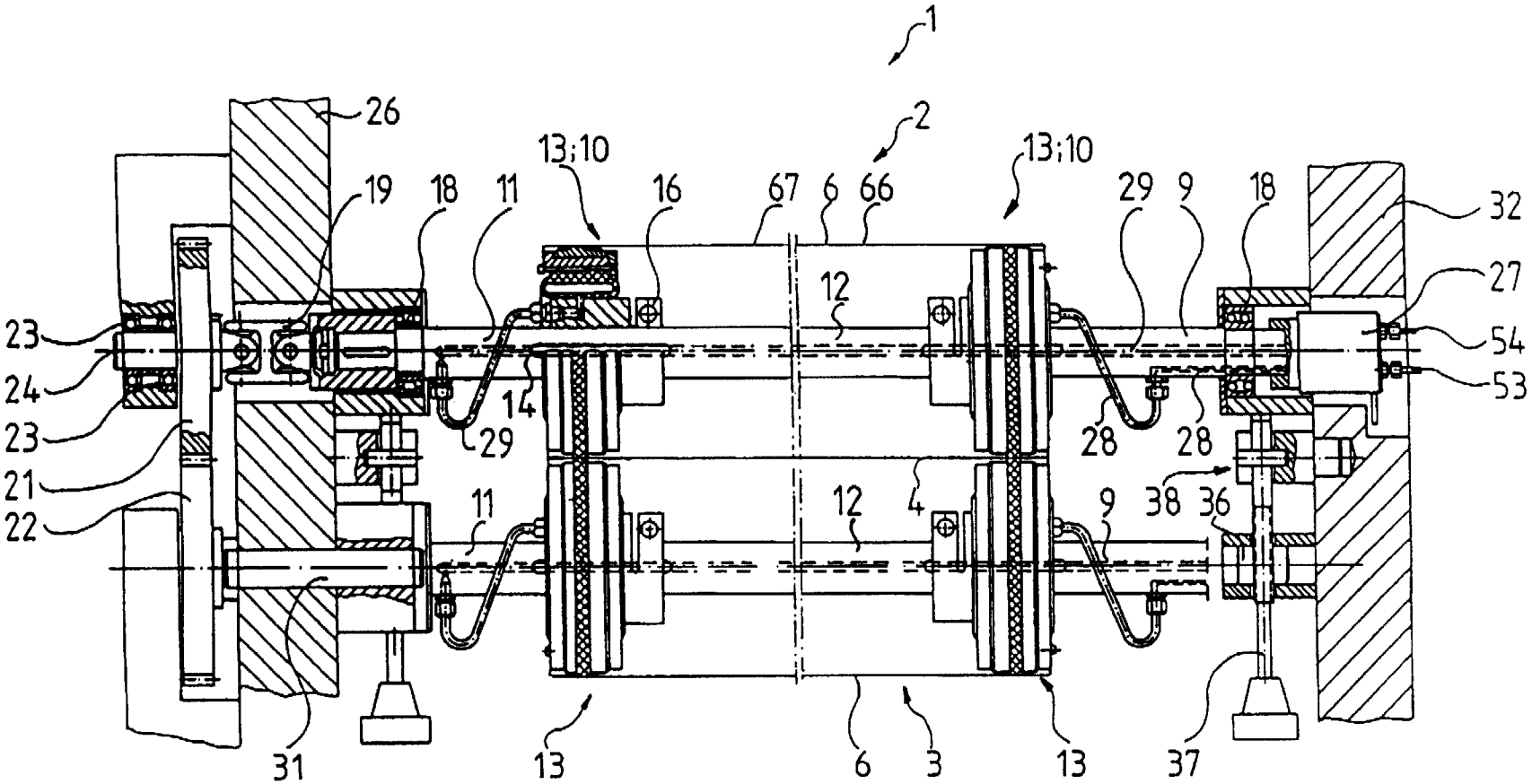
FIG. 4 is a schematic top plan view, partly in section, of a second preferred embodiment of a drawing roller pair in accordance with the present invention.

It is possible, in accordance with the present invention, to make a surface area 66 of the barrel 6 of each of the rollers 2 and 3 to be elastic in the radial direction and to transmit torque in the circumferential direction. For example, a sleeve 67, acting as the transport element 10, may be, for example, a pipe made of steel or of a synthetic-fiber reinforced plastic, which is seated on the continuous shaft 12 which forms the roller journals 9 and 11, by means of one or several compensating elements, and that forms the surface area 66 of the barrel 6. As was the case with the previously described transport wheels 13, these compensating elements can also consist of hoses which can be charged by a pressure medium, or can consist of the transport wheels 13, as seen in FIG. 4. For this purpose, a ring-shaped hose, for example a compensating ring 47, can be attached to each side of the sleeve 67, or a continuous pipe-like hose can be provided. It is also possible for an elastomeric material to be vulcanized between the sleeve 67 and the shaft 12, or radially acting springs can be disposed there. In the simplest case, the shaft 12 can be only covered with an elastomer coating, and the sleeve 67 can be omitted. It is also possible to provide one of the two rollers 2 or 3 with one or several elastic transport elements and to embody their counter-rollers in the customary form, for example as steel rollers.

The mode of operation of the drawing roller pair in accordance with the present invention will now be discussed in detail.

The web 4 being transported is guided between the driving elements, for example the transport wheels 13. To this end, the pressure chamber 51 of the compensating ring 47 is charged with pressure medium, because of which the web 4 is maintained between the transport wheels 13 under a defined pressure, which is independent of the axial spacing distance "a" between the rollers 2 and 3 or a thickness of the web 4. The rollers 2 and 3, with the transport wheels 13 fastened thereon, are driven by means of the two driving wheels 21 and 22, and the web 4 is transported. If it is necessary to change a circumferential speed of the transport wheels 13 to compensate for a change of the length of the web 4 because of changed pressure conditions, or in response to a changed coefficient of friction of the web 4, the axial distance "a" between the two rollers 2 and 3 can be reduced on both sides to an axial distance "a'" by means of the adjusting spindles 37. Because of this, the two compensating rings 47 are pushed out of their concentric positions with respect to the rollers 2 and 3 and into an eccentric position. In the process, the effective radius R48, resulting from the diameter D48 in the non-deflected state, is reduced to a reduced effective radius R48', because of which the circumferential speed of the transport wheels 13 is also reduced, even with constant rpm of the rollers 2 and 3. This difference resulting from the difference between the two effective radii R48, R48' corresponds to half the amount of the axial distance change. It is also possible to provide this change of the effective radius R48 only on one side, which results in a different circumferential speed at the two spaced lateral edges of the web 4. In this first preferred embodiment, the web 4 is held and transported by the transport wheels 13, while the barrels 6 of the rollers 2 and 3 are only used as support elements.

Referring now primarily to FIG. 4, there may be seen a second preferred embodiment of a drawing roller pair in accordance with the present invention. In this second preferred embodiment, the transport element 10, which includes the transport wheels 13, is part of the roller barrel 6. In this second preferred embodiment, without the separate transport wheels 13, the sleeve 67 of the rollers 2 and 3 is elastically seated in respect to the roller journals 9 and 11. In this second embodiment, in order to change the circumferential speed, the sleeve 67 is displaced from its concentric position into an eccentric position by a reduction of the axial distance "a" of the two rollers 2, 3, and its circumferential speed is reduced in this way. This reduction in the axial distance "a" is again accomplished by utilization of the threaded adjusting spindle 37 to move the two roller journals 9 and 11 closer to each other.

If only one roller 2 or 3 is provided with elastic transport elements, the circumferential speed of the roller 2 or 3 with the "solid" diameter remains the same when the axial distance "a" of the two rollers 2 and 3 is changed, while the circumferential speed of the roller 2 or 3 with elastic transport elements changes. In this case, the two roller 2 and 3 are not in an interlocking driven connection, only the roller 2 or 3 with the adjustable diameter is driven in an interlocking manner.

Since the transport elements are embodied with a lead, it is of course also possible to increase the circumferential speed past a nominal circumferential speed.

While preferred embodiments of a drawing roller pair in accordance with the present invention have been set forth fully and completely hereinabove, it will be apparent to one of skill in the art that a number of changes in, for example, the overall sizes and lengths of the rollers, the type of printing press in which the rollers are used, the drive source for the drive gears and the like could be made without departing from the true spirit and scope of the present invention which is accordingly to be limited only by the following claims.

What is claimed is:

1. A drawing roller pair for a web-fed rotary printing press for conveying a material web comprising:

first and second drawing rollers supported on first and second drawing roller support shafts;

means for varying an axial spacing distance between said roller support shafts;

an interlocking drive on at least one of said rollers; and transport elements carried by said first and second drawing roller support shafts, said transport element carried on said at least one driven roller being elastically supported in a radial direction and being capable of transmitting torque, an effective radius of said radially elastically supported transport element being reduced from a first radius to a second radius by reduction of said axial spacing distance to change a circumferential speed of said transport element.

2. The drawing roller pair of claim 1 wherein each of said transport elements is a transport wheel, each of said transport wheels having an outer running surface which is resiliently supported, and which is shiftable in a radial direction of said wheel and which transmits torque.

3. The drawing roller pair of claim 2 further including a barrel on each roller, and roller journals on said roller support shafts, said transport wheels being supported on said roller journals and to the sides of said roller barrel.

4. The drawing roller pair of claim 2 wherein said outer running surface is supported by an elastic compensating ring.

5. The drawing roller pair of claim 4 wherein said elastic compensating ring is a hose and further including means to charge said hose with a pressure medium.

6. The drawing roller pair of claim 4 wherein said elastic compensating ring is an elastomeric material.

7. The drawing roller pair of claim 2 wherein said outer running surface is supported by radially acting springs.

8. The drawing roller pair of claim 1 wherein said first and second drawing rollers have cylinder shaped surface areas, said cylinder shaped surface areas forming said transport elements.

9. The drawing roller pair of claim 8 wherein said cylinder shaped surface areas are formed on sleeves and wherein said sleeves are supported by an elastomeric material.

10. The drawing roller pair of claim 8 wherein said cylinder shaped surface areas cylinder shaped surface areas are formed on sleeves and wherein said sleeves are supported by a hose which can be charged with a pressure medium.

11. The drawing roller pair of claim 8 wherein said cylinder shaped surface areas are formed on sleeves and wherein said sleeves are supported by radial acting springs.

12. The drawing roller pair of claim 8 wherein said cylinder shaped surface areas are an elastomeric material.

13. The drawing roller pair of claim 1 wherein each of said first and second driving rollers is provided with one of said elastically supported transport elements.

14. The drawing roller pair of claim 13 further including interlocking drives for both said first and second drawing rollers.

* * * * *